United States Patent [19]

Abdel-Messeh

[11] 4,416,585

[45] Nov. 22, 1983

[54] BLADE COOLING FOR GAS TURBINE ENGINE

[75] Inventor: William Abdel-Messeh, Beloeil, Canada

[73] Assignee: Pratt & Whitney Aircraft of Canada Limited, Lonqueuil, Canada

[21] Appl. No.: 292,249

[22] Filed: Aug. 12, 1981

Related U.S. Application Data

[63] Continuation-in-part of Ser. No. 112,745, Jan. 17, 1980, abandoned.

[51] Int. Cl.[3] ..... F01D 5/08

[52] U.S. Cl. ..... 416/97 R; 416/95; 415/115

[58] Field of Search ..... 416/90 R, 97 R, 91, 416/92, 95, 96 A, 96 R, 97 A; 415/115

[56] References Cited

U.S. PATENT DOCUMENTS

| | | | |
|---|---|---|---|
| 2,956,773 | 10/1960 | French | 416/90 R |
| 3,171,631 | 3/1965 | Aspinwall | 416/97 R X |
| 3,628,885 | 12/1971 | Sidenstick et al. | 416/96 A |
| 4,236,870 | 12/1980 | Hucul, Jr. et al. | 416/97 R |
| 4,278,400 | 7/1981 | Yamarik et al. | 416/97 R |
| 4,302,153 | 11/1981 | Tubbs | 416/96 R |

FOREIGN PATENT DOCUMENTS

| | | | |
|---|---|---|---|
| 1355558 | 6/1974 | United Kingdom | 416/97 R |
| 1410019 | 10/1975 | United Kingdom | 416/97 |

*Primary Examiner*—Philip R. Coe
*Assistant Examiner*—Frankie L. Stinson
*Attorney, Agent, or Firm*—Fleit, Jacobson, Cohn & Price

[57] ABSTRACT

A hollow blade for a turbine in a gas turbine engine comprising passageways in the hollow blade for passing a coolant therethrough and pairs of ridges having a chevron shape and being segmented form a channel therebetween with corresponding pairs on opposed side walls of the passageway such that each corresponding opposed pair has the chevron angle open in opposite directions relative to the longitudinal direction of the passageway. In another embodiment the opposed pairs of ridges are in the same phase, that is with the angle open in the same direction.

11 Claims, 5 Drawing Figures

BLADE COOLING FOR GAS TURBINE ENGINE

CROSS-REFERENCE TO RELATED APPLICATION

This application is a continuation-in-part of U.S. application, Ser. No. 112,745, filed Jan. 17, 1980, and now abandoned.

BACKGROUND OF THE INVENTION

1. Field of the Invention

The present invention relates to a gas turbine engine, and more particularly, to the cooling of hollow blades for turbines in such engines.

2. Description of the Prior Art

In the manufacture of blades for turbines, it has been customary in recent years to include a hollow passageway in each blade, arranged in a serpentine fashion, for the purpose of passing a cooling fluid, such as air, so as to cool the blade. The inlet of air and the first section of passageway is arranged adjacent and parallel to the leading edge of the blade which may be the hottest portion of the blade. It has also been suggested to provide chordwise ribs spaced longitudinally of the passageway for promoting turbulence in the adjacent coolant boundary layer, thereby increasing the convective heat transfer coefficient. Such ribs were described in U.S. Pat. No. 3,628,885, Sidenstick et al, issued Dec. 21, 1971 to General Electric Company. These ribs extend at right angles to the axis of the passageway.

SUMMARY OF THE INVENTION

It is an aim of the present invention to provide an improved blade cooling arrangement, whereby the heat transfer coefficient can be increased without significantly increasing the pressure loss of the coolant fluid in the passageway.

A construction in accordance with the present invention comprises a blade, hollow passageways in the blade for passing a coolant therethrough in a direction parallel to the axis of the passageway, the passageway including opposed walls, at least one of the walls having longitudinally spaced-apart pairs of ridges formed on said wall, each ridge in a pair being spaced apart and defining an angle $\theta$ therebetween and each ridge defining an angle $\phi$ to the axis of the passageway and wherein:

$$\theta = 2\phi \geqq \pi/2.$$

In a more specific embodiment of the present invention, there are provided longitudinally spaced-apart pairs of ridges on opposed walls of the passageway with a corresponding pair located directly opposite on the other of the opposed walls to each of the pairs on the one wall. Each opposed corresponding pair on the other opposed wall has its angle $\theta$ facing the direction opposite to the facing of angle $\theta$ of the pair on the one wall.

Preferably, angle $\theta$ would be in the range of 140° to 160°.

The arrangement of the ridges described above enhances the creation of turbulence, particularly in the boundary layer (which is the layer of coolant adjacent the walls of the passageway). A rib arrangement as described in U.S. Pat. No. 3,628,885 will break up the boundary layer. However, by having pairs of ribs or ridges at an obtuse angle to each other in the form of a chevron and by having each ridge of a pair spaced apart from the other leaving a gap, the turbulence created by the vortex formed in the gap is much greater than that provoked by the straight perpendicular rib type as described in U.S. Pat. No. 3,628,885. The gap between each ridge in a pair forms a channel in the direction of the passageway, and as a result, the boundary layer of the fluid will flow towards the so-formed channel whereby it will be carried away by the mass flow, thus creating a vortex in the channel. This vortex causes increased turbulence in the passageway.

In U.S. Pat. No. 3,628,885, it was also recognized that although increased height of the ribs in the passage was desirable to increase the heat transfer coefficient, such increases in height would result in pressure losses. The ribs or ridges in the said patent are, as a result, maintained shallow, that is, with an e/D ratio of 0.06 and 0.07 where e is the height of the rib and D is the width between the side walls of the passageway on which the ribs are located.

The e/D ratio of the ridges of the present invention can be in the area of 0.030 to 0.100 without significant pressure drop, thereby increasing the heat transfer coefficient. However, the increased turbulence provided by the chevron arrangement of the ridges enhances still more the increase in heat transfer coefficient and is greater than that which would be obtained with a small increase in the height of the ridges.

This effect is even greater when corresponding chevron-shaped ridges are provided on the opposed wall of the passageway with chevron-shaped ridges being located in chordal alignment but with the angle $\theta$ of the ridge on the opposed wall, opened in a direction opposite to the direction of the opening of the angle $\theta$ of the respective ridge on the at least one wall. In other words, the respective ridges on the opposed wall are 180° out of phase with the ridges on the at least one wall. In such an arrangement, the vortexes formed by both series of ridges will intermix, thus provoking turbulence in the whole cooling mass flow, and as a result, improving considerably the heat transfer coefficient.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 2:
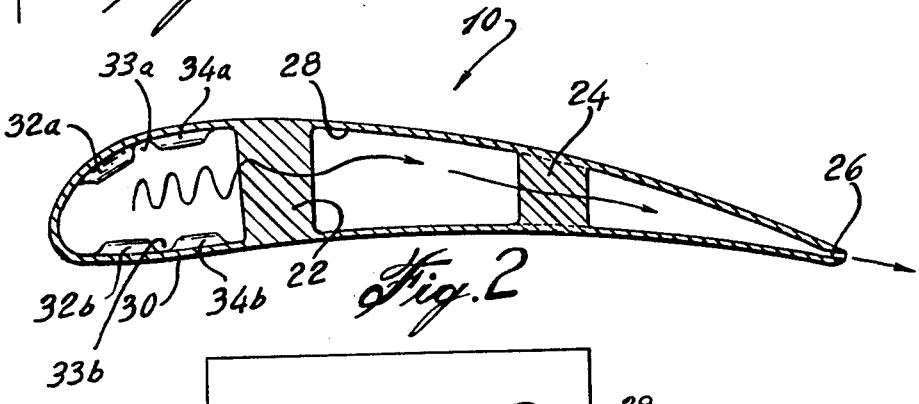
FIG. 2 is an enlarged horizontal cross-section taken along line 2—2 of FIG. 1 but enlarged somewhat.

The blade 10 has an airfoil shape, as shown in FIG. 2, and includes a leading edge 16 and a trailing edge 18. The blade 10 is hollow and includes a platform 12 integral with a root 14, and the blade 10 per se has a suction side wall 28 and a pressure side wall 30. A passage 20 is defined in the root 14 and communicates with a passageway formed by the baffle 22 and the leading edge wall 16 as well as portions of the side walls 28 and 30. The air entering through the passage 20 for cooling the blade is forced to flow along the leading edges wall 16 which is the hottest section of the blade. A separate baffle 24 is provided staggered between the baffle 22 and the trailing edge 18 of the blade 10. The baffle 24 causes the cooling air to move in a serpentine fashion towards the exhaust ports 26 in the narrow trailing edge of the blade exhausting into the gas flow.

Figure 1:
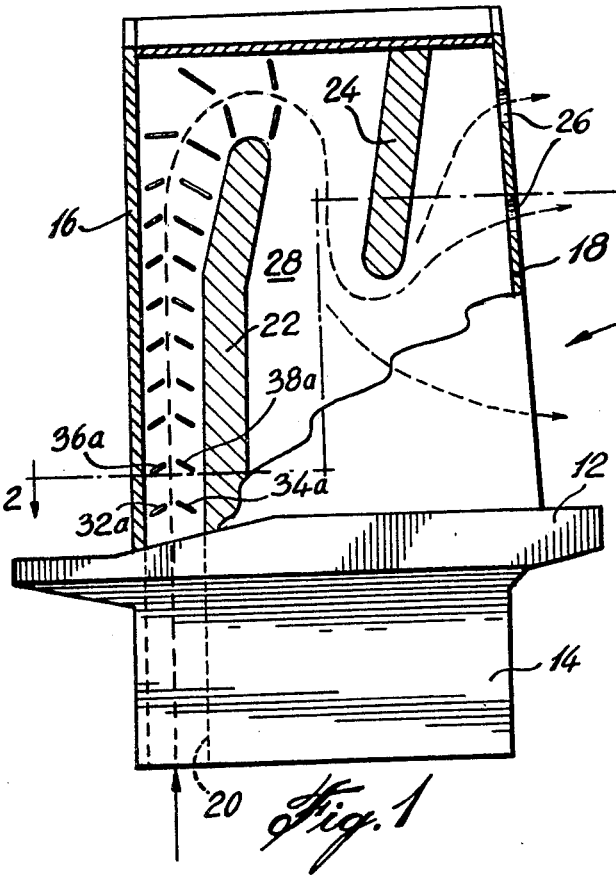
FIG. 1 is a side elevation of a typical hollow rotor blade for a turbine engine incorporating the present invention.
Figure 4:
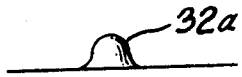
FIG. 4 is an enlarged end view of a further detail of the present invention, taken generally along the line 4—4 in FIG. 3.
Figure 3:
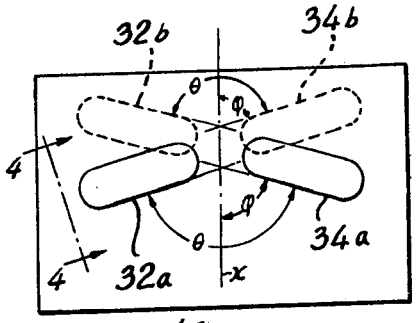
FIG. 3 is a fragmentary vertical elevation of a detail of the present invention.

At least in the leading edge passageway, there is provided on the side wall 28 ridges 32*a* and 34*a* which are formed integral with the side wall during the casting operation. As shown in FIGS. 3 and 4, each ridge has a somewhat rounded form. Ridges 32*a* and 34*a* are spaced apart to allow a gap 33*a* to form a channel therebetween. The respective ribs 32*a* and 34*a* are, of course, arranged to form a segmented chevron, as shown more clearly in FIGS. 1 and 3. Other ridges in chevron shapes, such as ridges 36*a* and 38*a*, are, of course, spaced longitudinally within the passageway.

On the opposite side wall, namely, side wall 30, there is a corresponding segmented chevron formed of ridges 32*b* and 34*b*, having a gap 33*b*, opposite the ridges 32*a* and 34*a*. The chevron shape of the ridges 32*b* and 34*b* is opposite, that is, the angle $\theta$ formed between the two ridges 32*b* and 34*b* opens in a longitudinal direction opposite to the opening of the angle $\theta$ between the ridges 32*a* and 34*a*, as shown, for instance, in FIG. 3, wherein the ridges 32*b* and 34*b* are shown in dotted lines and appear to overlap with the corresponding ridges 32*a* and 34*a*.

Figure 5:
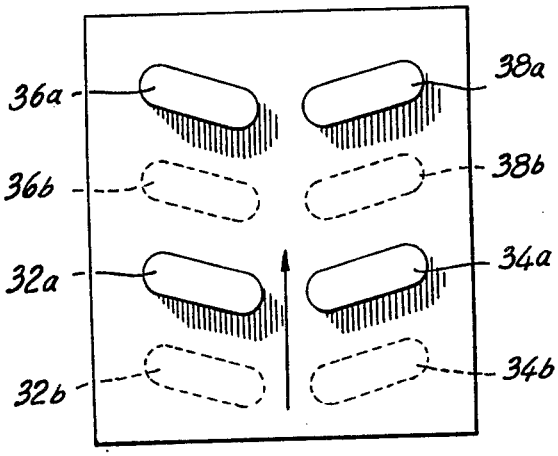
FIG. 5 is a fragmentary vertical elevation similar to FIG. 3 but showing a different embodiment thereof.

It has also been found that improved results will occur if the ridges 32*b* and 34*b* as well as 36*b* and 38*b* on the opposite side wall namely side wall 30, are placed in the same phase as the ridges 32*a* and 34*a* as well as 36*a* and 38*a* that is such that the angle $\theta$ formed between the two ridges 32*b* and 34*b* opens in the same longitudinal direction as the opening of the angle $\theta$ between ridges 32*a* and 34*a*. However, in this embodiment, the ridges 32*b*, 34*b*, 36*b* and 38*b* are staggered relative to the ridges 32*a*, 34*a*, 36*a* and 38*a*. An attempt to illustrate this embodiment is shown in FIG. 5 wherein the ridges 32*b*, 34*b*, 36*b* and 38*b* on wall 30 are shown in dotted lines relative to the ridges 32*a*, 34*a*, 36*a* and 38*a* on the wall 28. It is understood that angle $\theta$ can be opened in either longitudinal directions.

The provision of the segmented chevron ridges 32*a*, 34*a*, 32*b* and 34*b*, etc., in the passageway cause not only the boundary layer formed along the side walls to be broken up but creates a vortex in the channel formed between the segments, that is, between the ridges 32*a* and 34*a*, and these vortexes formed along the channels of opposite side walls intersect or mingle with each other.

As shown in FIG. 3, the ridges 32*a* and 34*a* are symmetrically arranged along the longitudinal axis of the passageway. This axis is identified by the letter "x" in FIG. 3, while the angle formed between the ridges 32*a* and 34*a* is identified by the angle $\theta$. The angle $\phi$ represents the angle between the axis x and the ridge 34*a*. In the present case, $\theta$ is equal to 2 $\phi$. Likewise, the ridges 32*b* and 34*b* on opposite side walls 30 are similarly arranged.

It has been found in tests carried out that the preferred range of angle $\theta$ would be between 140° and 160°. However, the ultimum angle is 150°, or, stated another way, angle $\phi$ is 75°.

The typical height of the ridge is 0.010". However, the height is dependent on the size of the hollow blades and, of course, will vary according to the distance between the walls 28 and 30. A typical width between the side walls 28 and 30 would amount to 0.100" but may vary between 0.030" and 0.25". If E is the height of the ridges and H is the width of the channel between the sidewalls 28 and 30 it follows that the ratio E/H must be in the range of 0.333 and 0.04 and the typical ratio E/H would be 0.10.

The gap between the ridges 32*a* and 34*a*, for instance, would be approximately 0.010". The spacing between the end of the ridges and the passageway walls is also approximately 0.010".

The segmented chevron-shaped ridges could be placed throughout the passageway around the baffles 22 and 24. However, it appears that they may be necessary only where a very high heat transfer coefficient is necessary such as in the leading edge area. The provision of ridges in the curved portion of the passageway above baffle 22 has been found to reduce cooling air stagnation in that area thereby reducing the possibility of hot spots.

I claim:

1. A blade for use in a gas turbine engine comprising hollow passageways in the blade for passing a coolant therethrough in a direction parallel to the axis of the passageway, the passageway including opposed walls, at least one of the walls having longitudinally spaced-apart pairs of ridges formed on said wall, each ridge in a pair being spaced apart to form a gap and defining an angle $\theta$ therebetween and each ridge defining an angle $\phi$ to the axis of the passageway, and wherein:

$$\theta = 2\phi \geqq \pi/2;$$

each ridge having a height E and the passageway having a width H between the opposed walls wherein the ratio E/H is within the range of 0.04 and 0.333.

2. A blade as defined in claim 1, wherein there are provided longitudinally spaced-apart pairs of ridges on opposed walls of the passageway with a corresponding pair located directly opposite on the other of the opposed walls to each of the pairs on the one wall, each opposed corresponding pair on the other opposed wall having its angle $\theta$ facing in a direction opposite to the angle $\theta$ of the pair on the one wall.

3. A blade as defined in claims 1 or 2, wherein the angle $\theta$ is in the range of 140° to 160°.

4. A blade as defined in claims 1 or 2, wherein the angle $\theta$ is 150°.

5. A blade as defined in claim 1, wherein the passageway is defined adjacent the leading edge of the blade and parallel to the leading edge for the complete length of the leading edge, and the passageway continues in a serpentine manner within the blade and communicates with exhaust ports at the trailing edge of the blade, and pairs of ridges are spaced longitudinally of the direction of the passageway at least for the complete portion of the passageway adjacent the leading edge of the blade, and opposed pairs of ridges are provided with a corresponding pair on each side wall adjacent the leading edge of the blade in the passageway.

6. A blade as defined in claim 5, wherein ridges are provided past a first bend in the serpentine passageway.

7. A blade as defined in claim 1, wherein the height of each ridge is 0.010" and the width of the passageway between opposed side walls between 0.030" to 0.25".

8. A blade as defined in claim 1, wherein there are provided longitudinally spaced apart pairs of ridges on opposed walls of the passageways with a corresponding pair located in a staggered manner relative to the longitudinal spacing of the ridges on the one wall and each opposed corresponding pair on the other opposed wall having its angle $\theta$ facing in a direction similar to the angle $\phi$ of the pair on the one wall.

9. A blade as defined in claim 1, wherein the gap is 0.010" wide.

10. A blade as defined in claim 1, wherein the gaps between the pairs of ridges are aligned coaxially with the axis of the passageway.

11. A blade as defined in claim 1, wherein the ratio E/H is 0.10.

* * * * *